US010093495B2

(12) United States Patent
Sugishima et al.

(10) Patent No.: US 10,093,495 B2
(45) Date of Patent: Oct. 9, 2018

(54) SELF-CLOSING DEVICE AND IMAGE FORMING APPARATUS

(71) Applicant: KYOCERA Document Solutions Inc., Osaka (JP)

(72) Inventors: Yoshio Sugishima, Osaka (JP); Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 255 days.

(21) Appl. No.: 14/796,863

(22) Filed: Jul. 10, 2015

(65) Prior Publication Data

US 2016/0009512 A1 Jan. 14, 2016

(30) Foreign Application Priority Data

Jul. 11, 2014 (JP) ..... 2014-143445
Jul. 9, 2015 (JP) ..... 2015-137912

(51) Int. Cl.
*B65H 1/26* (2006.01)

(52) U.S. Cl.
CPC ..... *B65H 1/266* (2013.01); *B65H 2402/343* (2013.01); *B65H 2405/114* (2013.01); *B65H 2405/214* (2013.01)

(58) Field of Classification Search
CPC ..... B65H 1/027; B65H 1/04; B65H 2405/31; B65H 2405/32; B65H 2405/35; B65H 1/00; B65H 2405/00; B65H 1/266
See application file for complete search history.

(56) References Cited

U.S. PATENT DOCUMENTS 5,253,015 A * 10/1993 Morita ..... G03G 15/6502 271/127
2006/0192331 A1* 8/2006 Nakashima ..... B65H 1/04 271/126
2012/0049713 A1* 3/2012 Tingle ..... A47B 88/42 312/334.33

FOREIGN PATENT DOCUMENTS

JP 2010-202330 A 9/2010
JP 2011-020789 A 2/2011
JP 2013-256355 A 12/2013
WO WO2004/098350 * 11/2004
WO 2010/143352 A1 12/2010

OTHER PUBLICATIONS

The extended European search report issued by the European Patent Office dated Nov. 23, 2015, which corresponds to European Patent Application No. 15176110.3-1705 and is related to U.S. Appl. No. 14/796,863.

(Continued)

*Primary Examiner* — Thomas A Morrison
(74) *Attorney, Agent, or Firm* — Studebaker & Brackett PC

(57) ABSTRACT

A self-closing device is configured to retract a unit capable of being pulled out with respect to an apparatus main body, to the apparatus main body. The self-closing device includes a plurality of retracting modules configured to retract the unit from a retracting start position towards a retracting end position. The plurality of retracting modules are provided such that retracting strokes from the retracting start position to the retracting end position partially overlap each other and the retracting start positions are different from each other in the retracting direction.

7 Claims, 12 Drawing Sheets

(56) References Cited

OTHER PUBLICATIONS

An Office Action issued by the Japanese Patent Office dated Mar. 13, 2018, which corresponds to Japanese Patent Application No. 2015-137912 and is related to U.S. Appl. No. 14/796,863; with English translation.

* cited by examiner

SELF-CLOSING DEVICE AND IMAGE FORMING APPARATUS

INCORPORATION BY REFERENCE

This application is based on and claims the benefit of priorities from Japanese Patent application No. 2014-143445 filed on Jul. 11, 2014 and Japanese Patent application No. 2015-137912 filed on Jul. 9, 2015, the entire contents of which are incorporated herein by reference.

BACKGROUND

The present disclosure relates to a self-closing device which retracts a unit such as a sheet feeding cassette to an apparatus main body and an image forming apparatus including this self-closing device.

In an image forming apparatus such as a printer or a multifunction peripheral, a sheet feeding cassette in which a sheet to be image-formed is housed is configured to be able to be pulled out with respect to an apparatus main body for replenishment of sheets or the like. In the image forming apparatus, there is provided a self-closing device in which, when the sheet feeding cassette is pushed toward the apparatus main body to a certain extent, the sheet feeding cassette is automatically retracted into a sheet feeding position.

By using the self-closing device, a load required to push the sheet feeding cassette by a user is reduced and thus workability is improved, and the sheet feeding cassette is easily positioned at the sheet feeding position. Also, the self-closing device is provided with a buffering member to buffer a biasing force in a direction in which the paper feeding cassette is retracted.

In a case where a spring is used as a biasing member for retracting the sheet feeding cassette, in respect of the spring characteristics, a difference occurs in biasing force at a time of start of retracting and at a time of completion of the retracting. In general, the biasing force at the time of completion of the retracting is weaker than the biasing force at the time of start of retracting. If the biasing force at the time of completion of the retracting is weak, there may be a case in which a problem occurs in positioning precision of the sheet feeding cassette at the sheet feeding position and thus it is preferable that the biasing force at the time of completion of the retracting be as high as possible. In order to reduce the difference in the biasing force and maintain the biasing force at the time of completion of the retracting, there is a need to increase in size of the spring; and however, in that case, there is a problem that a size of the self-closing device is increased and a degree of freedom in design is reduced.

On the other hand, if the biasing force at the time of completion of the retracting is increased, when a user pulls out the sheet feeding cassette at the time of replenishment of sheets or the like, a large force against this biasing force is required, and workability is impaired. Thus, it is difficult to satisfy both of improvement in the user workability and improvement in positioning precision of the sheet feeding cassette, which are contrary to each other.

As a self-closing device using a member other than a spring as a biasing member, there is proposed a self-closing device which retracts a sheet feeding cassette by using a self-weight of a weight. This self-closing device is constructed such that, when the sheet feeding cassette is pushed up to a predetermined position, the sheet feeding cassette is coupled to the weight and then is retracted to the sheet feeding position by the self-weight of the weight, whereas if the sheet feeding cassette is pulled out to the predetermined position, the coupling to the plumb is released, and thus a load required to pull out is reduced.

However, in the self-closing device which retracts the sheet feeding cassette by the self-weight of the weight, a space housing the weight is required, and the self-closing device becomes heavy by the weight and thus there is a problem that a size of the self-closing device is increased.

SUMMARY

In accordance with an embodiment of the present disclosure, a self-closing device is configured to retract a unit capable of being pulled out with respect to an apparatus main body, to the apparatus main body. The self-closing device includes a plurality of retracting modules configured to retract the unit from a retracting start position towards a retracting end position. The plurality of retracting modules are provided such that retracting strokes from the retracting start position to the retracting end position partially overlap each other and the retracting start positions are different from each other in the retracting direction.

In accordance with an embodiment of the present disclosure, an image forming apparatus includes a self-closing device. The self-closing device is configured to retract a unit capable of being pulled out with respect to an apparatus main body, to the apparatus main body. The self-closing device has a plurality of retracting modules configured to retract the unit from a retracting start position towards a retracting end position. The plurality of retracting modules are provided such that retracting strokes from the retracting start position to the retracting end position partially overlap each other and the retracting start positions are different from each other in the retracting direction.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference the drawings, a self-closing device and an image forming apparatus according to an embodiment of the present disclosure will be described.

Figure 1:
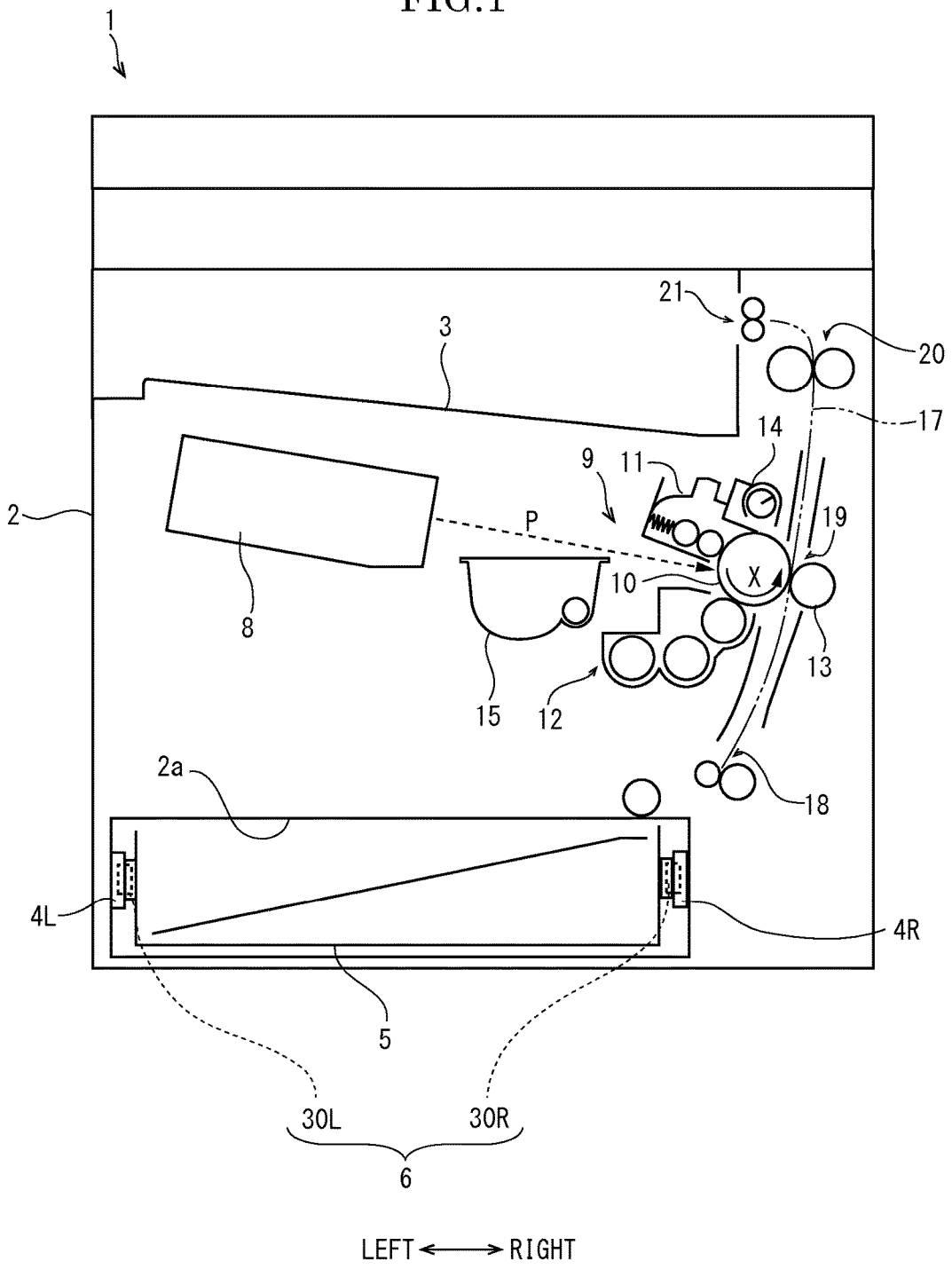
FIG. 1 is a schematic view showing a structure of a printer according to an embodiment of the present disclosure.

With reference to FIG. 1, a printer 1 as the image forming apparatus according to the embodiment of the present disclosure will be described. FIG. 1 is a front view schematically showing a structure of the printer. In the following description, the near side on a paper plane of FIG. 1 indicates the front side of the printer 1, and left and right directions are based on a direction in which the printer 1 is viewed from the front side.

As shown in FIG. 1, the printer 1 includes an box-formed printer main body 2 (apparatus main body). On a top surface of the printer main body 2, an ejected sheet tray 3 is provided. The printer main body 2 has a lower space 2*a* opened forward. On left and right side faces of the lower space 2*a*, a pair of rails 4L, 4R are provided in parallel facing each other. With the pair of rails 4L, 4R, a sheet feeding cassette 5 stored sheets (not shown) is slidably engaged. Between the pair of rails 4L, 4R and the sheet feeding cassette 5, a self-closing device 6 is provided. When the sheet feeding cassette 5 is pushed along the pair of rails 4L, 4R, the self-closing device 6 automatically retracts the sheet feeding cassette 5 to a sheet feeding position.

In the left part inside the printer main body 2, an exposure device 8 composed of a laser scanning unit (LSU) is arranged and, in the right part, an image forming part 9 is provided. In the image forming part 9, a photosensitive drum 10 as an image carrier is rotatably arranged. Around the photosensitive drum 10, a charger 11, a development unit 12, a transferring roller 13 and a cleaning device 14 are located along a rotating direction (refer to an arrow X in FIG. 1) of the photosensitive drum 10. The development unit 12 is connected to a toner (developer) container 15.

On a right side of the image forming part 9, a sheet conveying path 17 extending vertically from the sheet feeding cassette 5 to the ejected sheet tray 3 is provided. Along the sheet feeding path 17, a sheet feeding part 18 on a right side of the lower space 2 is provided at an upstream end, a transferring part 19 formed between the photosensitive drum 10 and transferring roller 13 is provided at an intermediate stream portion, a fixing device 20 is provided at a downstream part and a sheet ejecting part 21 is provided at an downstream end. The sheet feeding part 18 is configured to be engaged with the sheet feeding cassette 5 and then to feed the sheet stored in the sheet feeding cassette 5 when the sheet feeding cassette 5 is retracted to the sheet feeding position by the self-closing device 6.

Next, the operation of forming an image by the printer 1 having such a configuration will be described.

When the power is supplied to the printer 1, various parameters are initialized and initial determination, such as temperature determination of the fixing device 20, is carried out. Subsequently, when image data is inputted and a printing start is directed from a computer or the like connected with the printer 1, image forming operation is carried out as follows.

First, the surface of the photosensitive drum 10 is electric-charged by the charger 11. Then, exposure corresponding to the image data on the photosensitive drum 10 is carried out by a laser light P from the exposure device 8, thereby forming an electrostatic latent image on the surface of the photosensitive drum 10. Subsequently, the electrostatic latent image is developed by the development unit 12 into a toner image.

On the other hand, a sheet fed from the sheet feeding cassette 5 by the sheet feeding part 18 is conveyed to the transferring part 19 in a suitable timing for the above-mentioned image forming operation, and then, the toner image on the photosensitive drum 10 is transferred onto the sheet in the transferring part 19. The sheet with the transferred toner image is conveyed to a downstream side in the conveying path 17 to go forward to the fixing device 20, and then, the toner image is fixed on the sheet in the fixing device 20. The sheet with the fixed toner image is ejected to the ejected sheet tray 3 from the sheet ejecting part 21. The toner remained on the photosensitive drum 10 is collected by the cleaning device 14.

Figure 2:
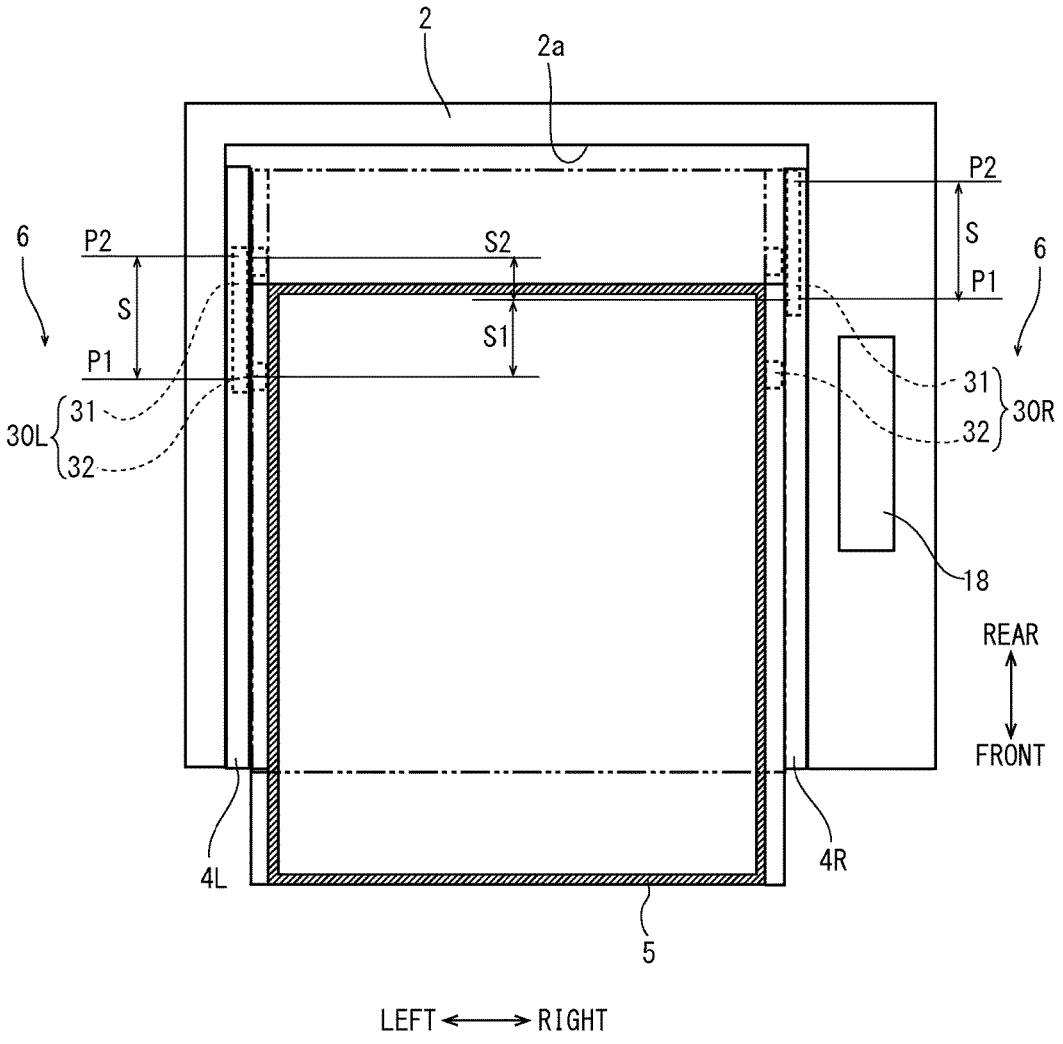
FIG. 2 is a plan view showing a layout of retracting modules in a self-closing device according to a first embodiment of the present disclosure.

Next, the self-closing device 6 will be described with reference to FIG. 2. FIG. 2 is a plan view showing a layout of the self-closing device.

The self-closing device 6 has left and right retracting modules 30L, 30R. The left and right retracting modules 30L, 30R respectively have: an engaged part 31 provided between a retracting start position P1 and a retracting end position P2 along a retracting direction of the sheet feeding cassette 5; and an engaging part 32 engaging with the engaged part 31 at the retracting start position P1 to be retracted to the retracting end position P2. An interval between the retracting start position P1 and the retracting end position P2 is defined as a retracting stroke S. The left and right retracting modules 30L, 30R have the same retracting stroke S. In the left and right retracting modules 30L, 30R, the engaged parts 31 are provided on the left and right rails 4L, 4R, and the engaging parts 32 are provided on the left and right side faces of the sheet feeding cassette 5.

The left and right retracting modules 30L, 30R are arranged such that the respective retracting strokes partially overlap each other and the retracting start positions P1 are different from each other. Specifically, the retracting start position P1 of the right retracting module 30R is located on a downstream side in the retracting direction from the retracting start position P1 of the left retracting module 30L. Namely, the engaged part 31 of the left retracting module 30L is arranged on a slightly rear side from a center of the left rail 4L, and the engaged part 31 of the right retracting module 30R is arranged near a rear end of the right rail 4R.

By such arrangement, between the retracting start positions P1 of the left and right modules 30L, 30R, a region S1 in which only a retracting force of the left retracting module 30L acts is formed, and between the retracting start position P1 of the left retracting module 30R and the retracting end position P2 of the left retracting module 30L, a region S2 in which the retracting strokes S overlap each other is formed.

In addition, the left retracting module 30L is such arranged that when the engaging part 32 is engaged with the engaged part 31 and then retracted to close to the retracting end position P2 (the position indicated by double-dotted chain line of FIG. 2), the sheet feeding cassette 5 is positioned into the sheet feeding position. On the other hand, the right retracting module 30R is such arranged that the engaging part 32 is positioned at the same position in the forward/rearward direction as that of the engaging part 32 of the left retracting module 30L. Thus, when the engaging part 32 of the left retracting module 30L is retracted to close to the retracting end position P2, the engaging part 32 of the right retracting module 30R is retracted only to a middle of the retracting stroke S.

Figure 3A:
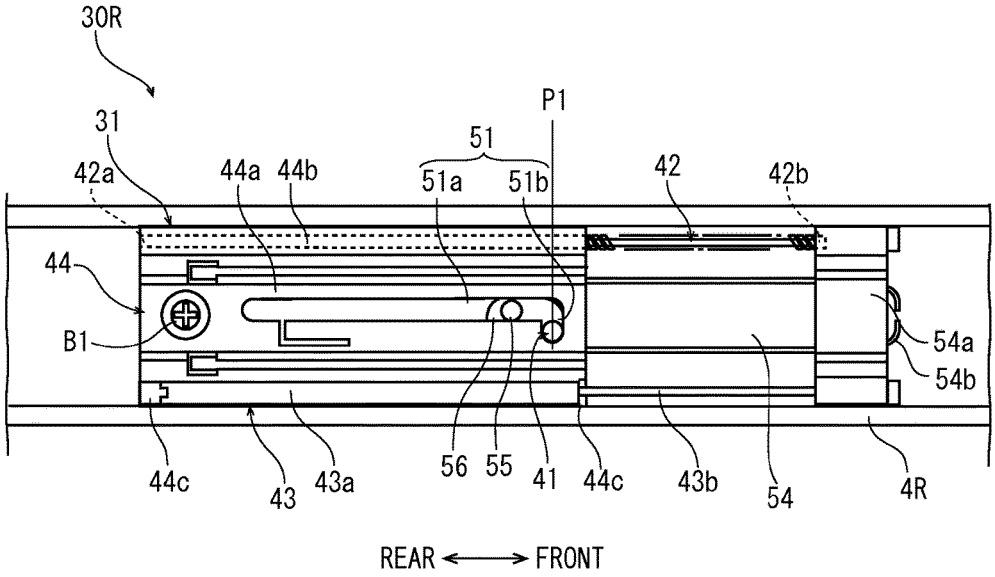
FIG. 3A is a side view an engaged part of a right retracting module at a retracting start position seen from a left side, in the self-closing device according to the first embodiment of the present disclosure.
Figure 3B:
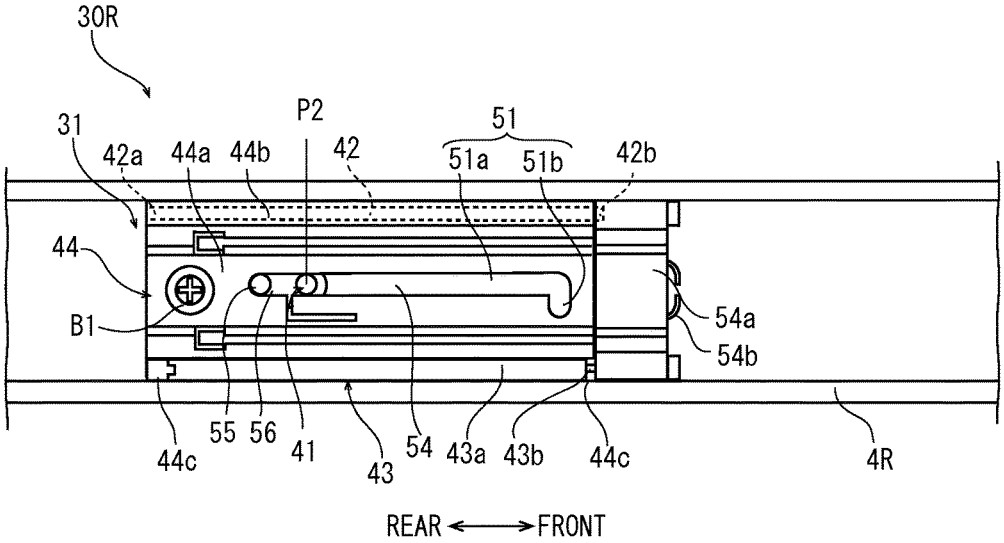
FIG. 3B is aside view of the engaged part of the right retracting module at a retracting end position seen from the left side, in the self-closing device according to the first embodiment of the present disclosure.
Figure 4:
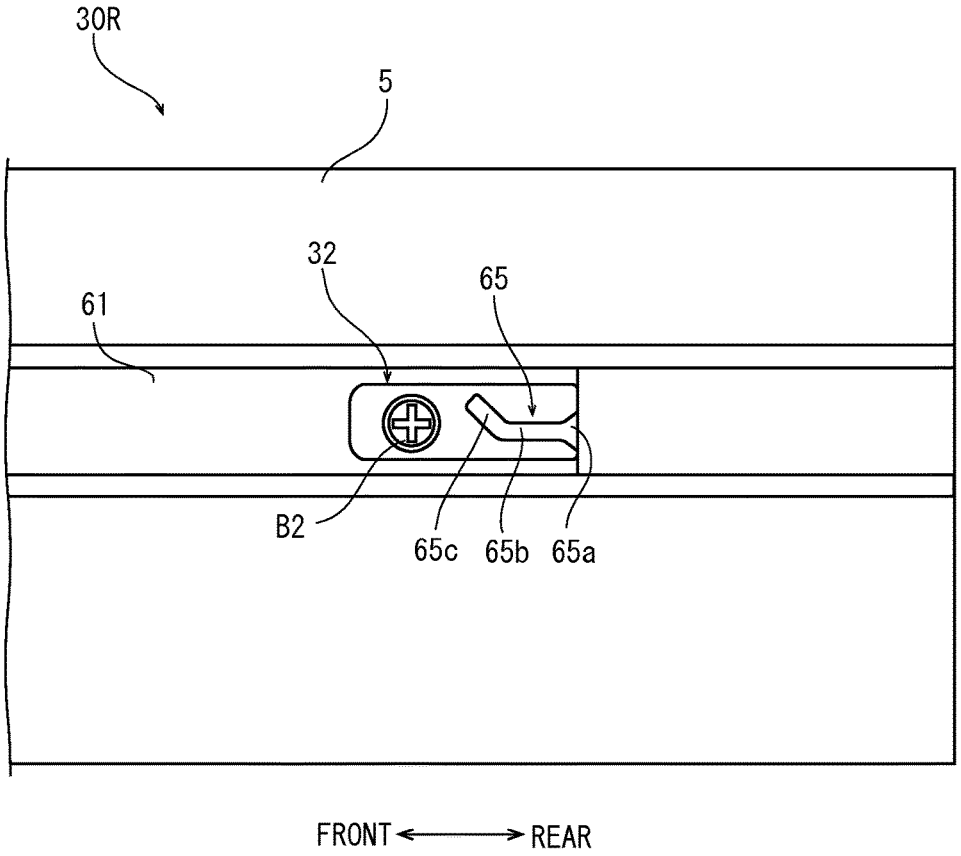
FIG. 4 is a side view of an engaging part of the right retracting module seen from a right side, in the self-closing device according to the first embodiment of the present disclosure.
Figure 5:
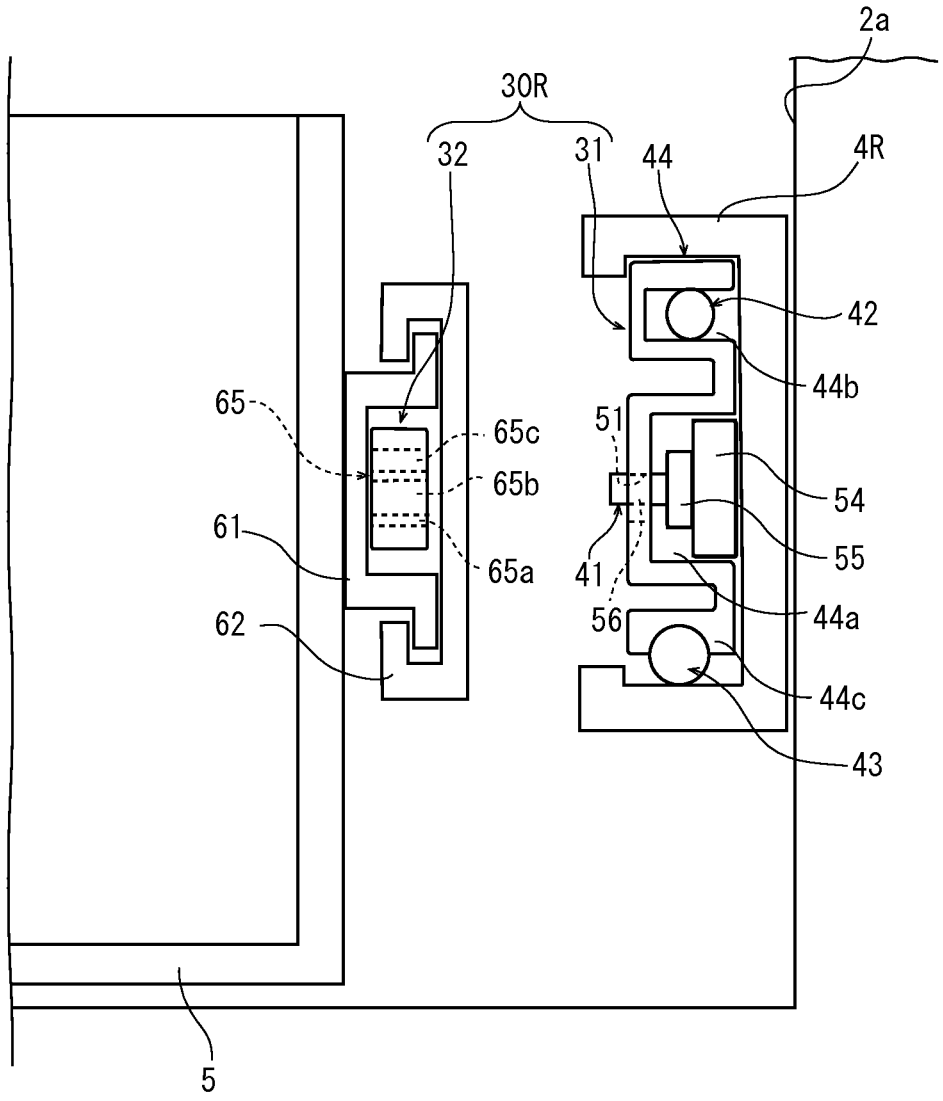
FIG. 5 is a front view showing the engaged part and the engaging part, in the retracting module of the self-closing device according to the first embodiment of the present disclosure.

Next, with reference to FIGS. 3A to 5, a structure of the left and right retracting modules 30L, 30R will be described. FIGS. 3A and 3B are side views showing the engaged part of the right retracting module seen from the left side, FIG. 3A shows the engaged part at the retracting start position, and FIG. 3B shows the engaged part at the retracting end position. FIG. 4 is a side view showing the engaging part of the right retracting module seen from the right side. FIG. 5 is a front view showing the engaged part and the engaging part of the retracting module.

As shown in FIGS. 3A and 3B, the engaged part 31 of the right retracting module 30R includes: a carriage pin 41 slidable along the right rail 4R in the length direction; a coil spring 42 to bias the carriage pin 41 rearward; and an oil damper (buffering member) 43 to buffer a biasing force of the coil spring 42. The carriage pin 41, the coil spring 42 and the oil damper 43 are supported on a base member 44. Incidentally, the left retracting module 30L also has a similar structure as that of the right retracting module 30R.

The base member 44 is a rectangular member elongated in the length direction of the right rail 4R and having a width equal to a width of the right rail 4R, and is secured to a bottom face of the right rail 4R by a screw B1. The base member 44 has a central recessed part 44*a* and an upper recessed part 44*b* extending in the length direction of the right rail 4R at a center and an upper end in the width direction, respectively. The center recessed part 44*a* and the upper recessed part 44*b* each are open toward the outside (outside of the lower space 2*a* of the printer 2), the center recessed part 44*a* has a wide rectangular sectional shape, and the upper recessed part 44*b* has a substantially square sectional shape. On a lower edge of the base member 44, hook portions 44*c* are formed at front and rear ends.

The center recessed part 44*a* is formed with a guide hole 51 along the length direction of the right rail 4R. The guide hole 51 has: a linear portion 51*a* along the length direction of the right rail 4R; and an orthogonal portion 51*b* curving downward at an angle of 90 degrees from a front end of the linear portion 51*a*.

The carriage pin 41 is provided on a slider 54 slidably supported in the center recessed part 44*a* of the base member 44. The slider 54 is a flat, rectangular solid-shaped member elongated in the length direction of the base member 44. At a front end of the slider 54, a stopper 54*a* extending in a direction crossing the length direction of the slider 54 is formed. On a front end face of the stopper 54*a*, a plurality of elastic pieces 54*b* are provided.

On a rear end portion of an inner face of the slide 54, a supporting pin 55 extending in a horizontal direction is erected, and around the supporting pin 55, a piece 56 is turnably supported. The carriage pin 41 is erected on an inner face of the piece 56. The supporting pin 55 and the carriage pin 41 engage with the guide hole 51 with the carriage pin 41 on a front side from the supporting pin 55. Also, the carriage pin 41 protrudes inward from the guide hole 51. If the slider 54 is slid forward along the guide hole 51 with the supporting pin 55 and the carriage pin 41 engaged with the guide hole 51, the carriage pin 41 is engagingly locked with a curved face of the guide hole 51. Afterwards, the piece 56 turns in the clockwise direction of FIG. 3 around the supporting pin 55 so that the carriage pin 41 engages with the orthogonal portion 51*b* along the curved face of the guide hole 51. If the carriage pin 41 engages with the orthogonal portion 51*b* of the guide hole 51, a sliding operation of the slider 54 along the guide hole 51 is restrained.

The slider 54 slides in the length direction of the right rail 4R in the center recessed part 44*a* of the base member 44 between the retracting start position P1 (refer to FIG. 3A) at which the carriage pin 41 engages with the orthogonal portion 51*b* of the guide hole 51 and the retracting end position P2 (refer to FIG. 3B) at which the supporting pin 55 reaches a rear end of the linear part 51*a* of the guide hole 51. An interval between the retracting start position P1 and the retracting position P2 is defined as a movement distance of the slider 54, that is, the retracting stroke S of the right retracting module 30R. Incidentally, at the retracting end position P2, the stopper 54*a* of the slider 54 abuts against the front end of the base member 44.

The coil spring 42 is housed in the upper recessed part 44*b* of the base member 44. A rear end 42*a* of the coil spring 42 is engagingly locked with a rear end of the upper recessed part 44*b*, and a front end 42*b* is engagingly locked with the stopper 54*a* of the slider 54. The coil spring 42 biases the stopper 54*a* rearward. That is, the coil spring 42 biases the slider 54 to the retracting end position P2.

The oil damper 43 has a cylinder 43*a* and a piston 43*b*. The cylinder 43*a* is supported by the hook portions 44*c* of the base member 44 with the piston 43*b* directing forward. A tip end of the piston 43*b* is supported by the stopper 54*a* of the slider 54*a*. Incidentally, an air damper may be used in place of the oil damper 43.

As shown in FIG. 4, the engaging part 32 of the right retracting module 30R is provided at a main slider 61 secured to the right side face of the sheet feeding cassette 5.

The main slider 61 has a length equal to a length of the right rail 4R, and is secured to the right side face of the sheet feeding cassette 5 so as to correspond to the right rail 4R.

The main slider 61, as shown in FIG. 5, slidably engages with a relay slider 62, and the relay slider 62 slidably engages with the right rail 4R on a front side of the engaged part 31 of the right retracting module 30R. By providing such a relay slider 62, it is possible to increase a pulling out length of the sheet feeding cassette 5, and when the sheet feeding cassette 5 is pulled out, the sheet feeding cassette 5 can be maintained substantially in parallel to the left and right rails 4L, 4R.

As shown in FIG. 4, the engaging part 32 is a plate piece-shaped member elongated in the length direction of the main slider 61, and is secured to an outer face of the main slider 61 (an opposite face to the sheet feeding cassette 5) by a screw B2. The engaging part 32 has a recessed part 65 extending forward from a rear end face. The recessed part 65 has a width slightly larger than a diameter of the carriage pin 41. The recessed part 65 has: an opening 65*a* of which a width becomes wider toward a rear side; a horizontal portion 65*b* extending forward along the length direction of the right rail 4R from the opening 65*a*; and an inclined portion 65*c* inclined forward in an oblique upper direction from a front end of the horizontal portion 65*b*.

With reference to FIGS. 3 to 7B, a retracting operation of the sheet feeding cassette 5 by the self-closing device 6 having the above configuration will be described. FIGS. 6A to 7B are plan views illustrating an operation of retracting the sheet feeding cassette by the self-closing device.

Figure 6B:
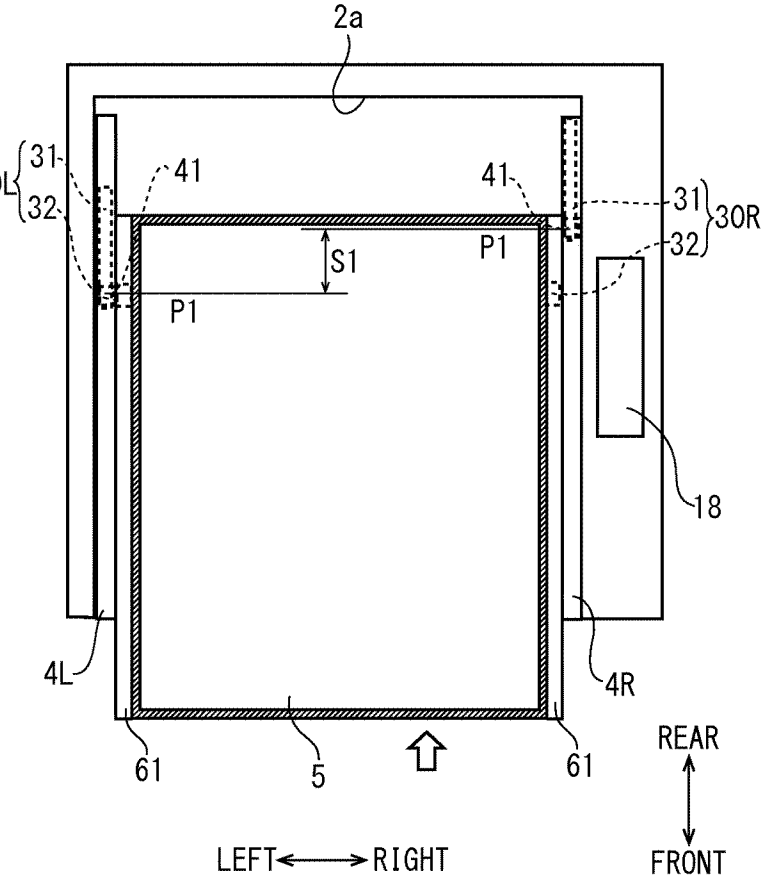
FIG. 6B is a plan view showing the self-closing device, in which a left retracting module reaches a retracting start position, according to the first embodiment of the present disclosure.
Figure 6A:
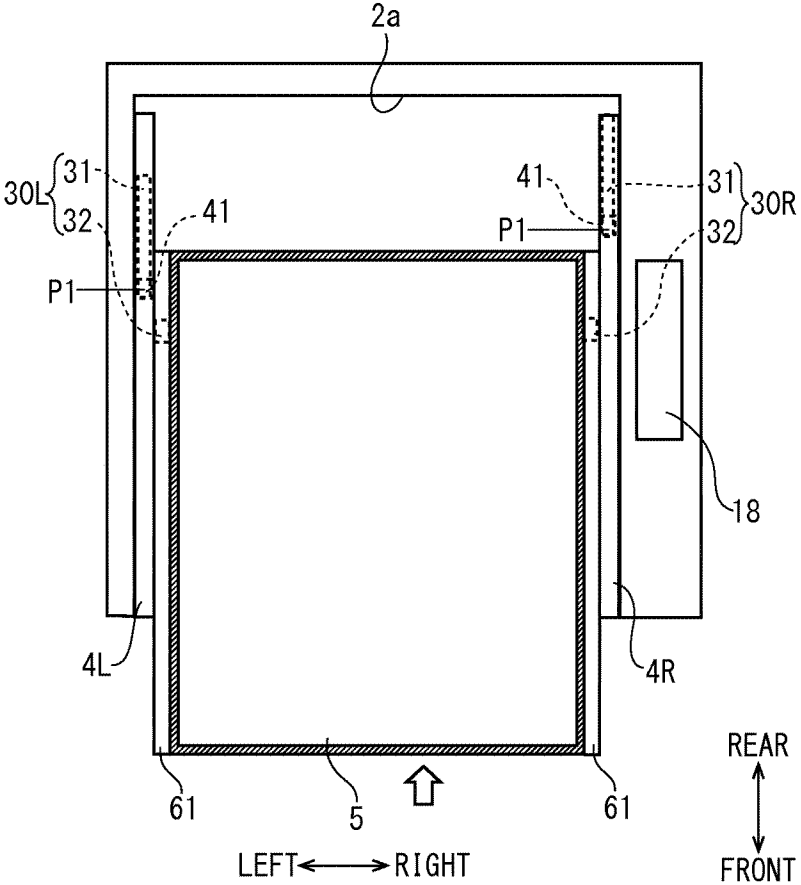
FIG. 6A is a plan view illustrating the self-closing device before starting a retracting operation according to the first embodiment of the present disclosure.

As shown in FIG. 6A, in a state in which the sheet feeding cassette 5 is pulled out, in the left and right retracting modules 30L, 30R, the engaged part 31 and the engaging part 32 are disengaged from each other, and the carriage pin 41 of the engaged part 31 slides to the retracting start position P1.

If the sheet feeding cassette 5 is pushed along the left and right rails 4L, 4R (refer to the outline arrow of FIG. 6A), as shown in FIG. 6B, first, in the left retracting module 30L, the engaging part 32 provided on the left side face of the sheet feeding cassette 5 engages with the engaged part 31 provided on the left rail 4L. In detail, the carriage pin 41 of the engaged part 31 is inserted into the horizontal portion 65*b* from the opening 65*a* of the recessed part 65 of the engaging part 32 shown in FIG. 4.

If the sheet feeding cassette 5 is further pushed, the inclined portion 65*c* of the recessed part 65 of the engaging part 32 abuts against the carriage pin 41, and the carriage pin 41 is guided upward along the inclined portion 65*c* so that the piece 56 turns in the counterclockwise direction of FIG. 3A around the supporting pin 55. In this manner, the carriage pin 41 moves from the orthogonal portion 51*b* into the linear portion 51*a* in the guide hole 51, and the carriage pin 41 and the orthogonal part 51*b* are disengaged from each other. That is, the slider 54 and the base member 44 are disengaged from each other. Then, the slider 54 is biased by the coil spring 42, and the carriage pin 41 slides along the linear portion 51*a* of the guide hole 51 rearward while engaging with the inclined portion 65*c* of the engaging part 32. That is, the sheet feeding cassette 5 is retracted toward the sheet feeding position.

Figure 7B:
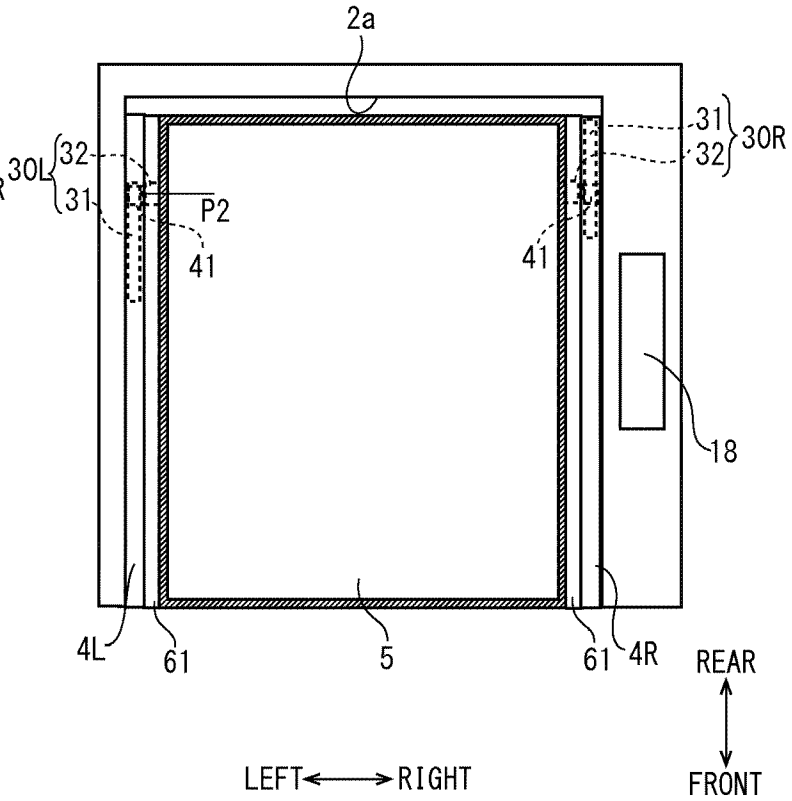
FIG. 7B is a plan view showing the self-closing device, in a state where a sheet feeding cassette is retracted to a sheet feeding position, according to the first embodiment of the present disclosure.
Figure 7A:
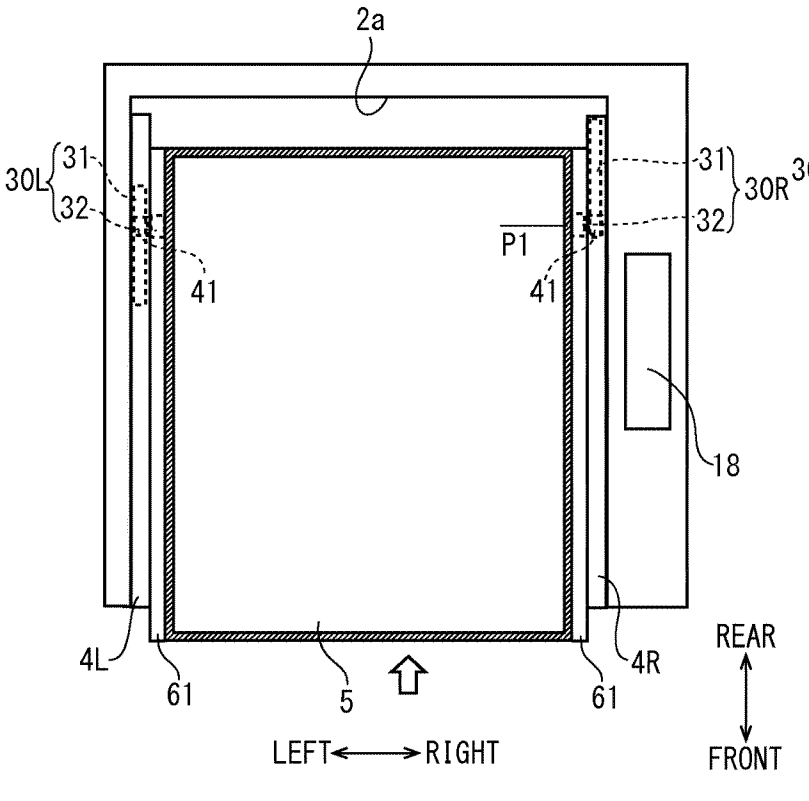
FIG. 7A is a plan view showing the self-closing device, in which the right retracting module reaches the retracting start position, according to the first embodiment of the present disclosure.

On the other hand, in the right retracting module 30R, in a middle of retracting of the sheet feeding cassette 5 by the left retracting module 30L, as shown in FIG. 7A, if the engaging part 32 reaches the retracting start position P1, the engaging part 32 engages with the engaged part 31, and then a retracting operation which is the same as the retracting operation in the left retracting module 30L is started. Then, the sheet feeding cassette 5 is retracted by the left and right retracting modules 30L, 30R by a length of the overlap region S2 of the left and right retracting modules 30L, 30R.

Afterwards, as shown in FIG. 7B, the engaging part 32 of the left retracting module 30L slides up close to the retracting end position P2, and the sheet feeding cassette 5 is positioned into the sheet feeding position. During this sliding operation, a biasing force of the coil spring 42 is buffered by the oil damper 43. Accordingly, the slider 54 is slowly retracted and, furthermore, the impact at the time of completion of retracting can be restrained. Also, when the engaging part 32 of the left retracting module 30L slides up close to the retracting end position P2, the stopper 54*a* of the slider 54 moves close to the front end of the base member 44 (refer to FIG. 3B).

Incidentally, as shown in FIG. 7B, the engaging part 32 of the right retracting module 30R is retracted only up to the middle of the retracting stroke.

Next, an operation of pulling out the sheet feeding cassette 5 will be described. At the time of starting the pulling out operation, in the left and right retracting modules 30L, 30R, a force against the biasing force of each coil spring 42 of the engaged parts 31 is required. If the sheet feeding cassette 5 is pulled out against the biasing forces of the coil springs 42 of the left and right retracting modules 30L, 30R, the engaging part 32 of the right retracting module 30R reaches close to the retracting start position P1 (refer to FIG. 7A). And, the carriage pin 41 of the engaged part 31 engaged with the engaging part 32 comes in contact with the front end of the guide hole 51 and then guided downward by the inclined portion 65*c* so as to be engagingly locked with the orthogonal portion 51*b* of the guide hole 51. Then, the carriage pin 41 is separated away from the recessed part 65 and the engaging part 32 and the engaged part 31 are therefore disengaged from each other. In this manner, in the subsequent pulling out operation, the biasing force of the coil spring 42 of the right retracting module 30R does not act. An operation of disengaging the engaging part 32 and the engaged part 31 from each other is a reverse operation of an engaging operation, and a detailed description is omitted.

That is, in the region S1 between the retracting start position P1 of the right retracting module 30R and the retracting start position P1 of the left retracting module 30L, only the biasing force of the coil spring 42 of the left retracting module 30L acts on the sheet feeding cassette 5. If the sheet feeding cassette 5 is pulled out against this biasing force, the engaging part 32 of the left retracting module 30L reaches the retracting start position P1 (refer to FIG. 6B), and the engaging part 32 and the engaged part 31 are disengaged from each other. Afterwards, the sheet feeding cassette 5 is pulled out along the left and right rails 4L, 4R without any resistance (refer to FIG. 6A).

As described above, according to the self-closing device 6 of an embodiment of the present disclosure, in the middle of pulling out operation of the sheet feeding cassette 5 within a range of the retracting stroke S of the self-closing device 6, since the engaging part 32 and the engaged part 31 in the right retracting module 30R are disengaged from each other and thus the biasing force in the retracting direction does not act, a maximum value of the pulling out force can be reduced.

Further, a retracting start timing of the right retracting module 30R arranged closer to the sheet feeding device 18 is configured to be later than a retracting start timing of the left retracting module 30L. In this manner, in the right retracting module 30R arranged closer to the sheet feeding device 18, since a retracting force required to retract the sheet feeding cassette 5 toward the sheet feeding position exhibits comparatively significantly at the retracting end position P2, the sheet feeding cassette 5 can be smoothly retracted to the sheet feeding position.

Incidentally, the left and right retracting modules 30L, 30R are not always provided with the oil damper 43. However, if the left retracting module 30L having a longer rectangle stroke is provided with the oil damper 43, an impact buffering effect at the retracting work can be enhanced. As an impact buffering member during the retracting operation, it is preferable to use the oil damper 43 or an air damper which is inexpensive and versatile.

Further, since the left and right retracting modules 30L, 30R are incorporated in the left and right rails 4L, 4R with which the sheet feeding cassette 5 engages, an exclusive space for installing the self-closing device 6 is unrequired. Further, since the left and right retracting modules 30L, 30R are small in size and light in weight, the size and weight of the image forming apparatus 1 can be reduced.

Figure 8:
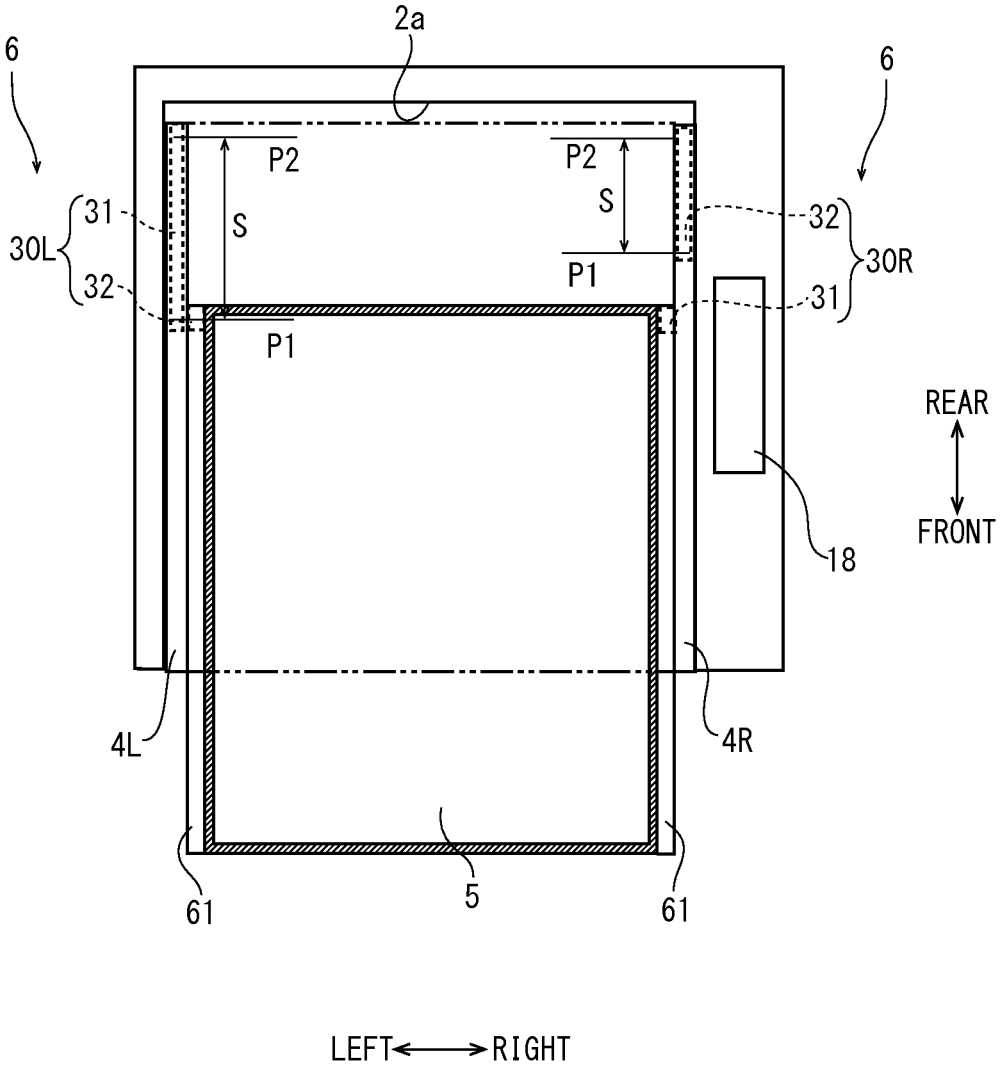
FIG. 8 is a plan view showing a layout of retracting modules in a self-closing device according to a second embodiment of the present disclosure.

Next, with reference to FIGS. 8 to 10B, a self-closing device according to a second embodiment of the present disclosure will be described. FIG. 8 is a plan view showing an arrangement of the self-closing device, and FIGS. 9A to 10B are plan views illustrating an operation of retracting the sheet feeding cassette by the self-closing device.

In the self-closing device 6 according to the second embodiment, as shown in FIG. 8, the left retracting module 30L has a retracting stroke S longer in length than the retracting stroke S of the right retracting module 30R. In addition, the left and right retracting modules 30L, 30R are respectively arranged on the left and right rails 4L, 4R such that the retracting start position P1 of the left retracting module 30L is located on the upstream side in the retracting direction from the retracting start position P1 of the right retracting module 30R, and the retracting end positions P2 of the left and right retracting modules 30L, 30R are positioned at the same position in the retracting direction (forward/rearward directions). Also, spring constants of the coil springs 42 of the left and right retracting modules 30L, 30R are set such that retracting forces of the left and right retracting modules 30L, 30R are substantially the same as each other at the respective retracting end positions P2.

Figure 9B:
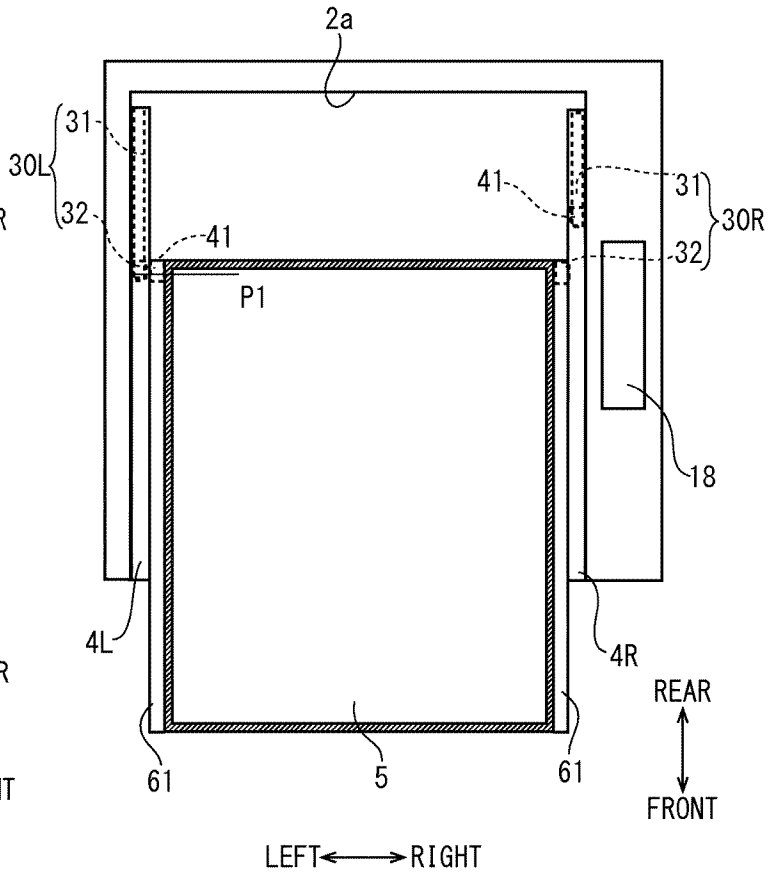
FIG. 9B is a plan view showing the self-closing device, in which a left retracting module reaches a retracting start position, according to the second embodiment of the present disclosure.
Figure 9A:
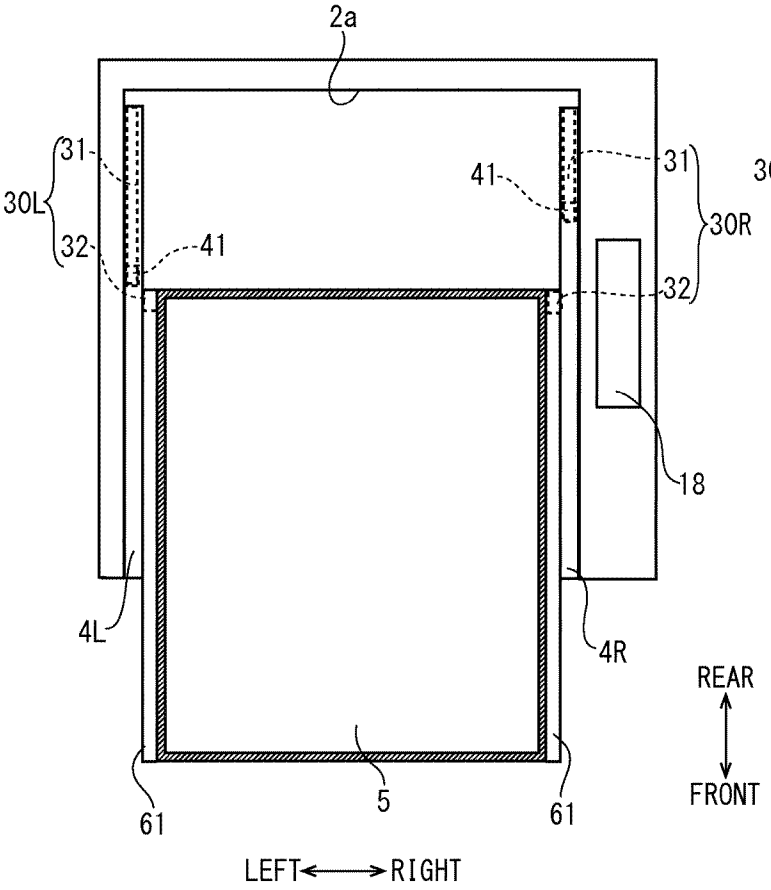
FIG. 9A is a plan view showing the self-closing device before starting a retracting operation according to the second embodiment of the present disclosure.

As shown in FIG. 9A, in a state in which the sheet feeding cassette 5 is pulled out, in the left and right retracting modules 30L, 30R, the engaged part 31 and the engaging part 32 are disengaged from each other, and the carriage pin 42 of the engaged part 31 slides into the retracting start position P1. If the sheet feeding cassette 5 is pushed along the pair of rails 4L, 4R, as shown in FIG. 9B, first, the engaging part 32 of the left retracting module 30L engages with the engaged part 31.

Figure 10B:
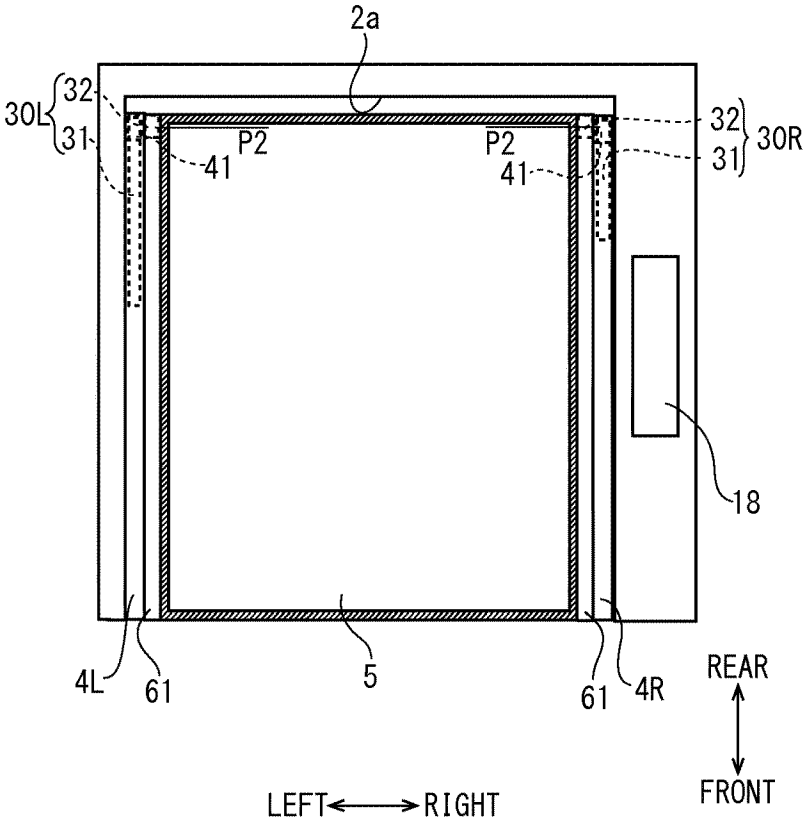
FIG. 10B is a plan view showing the self-closing device in a state where a sheet feeding cassette is retracted to a sheet feeding position, according to the second embodiment of the present disclosure.
Figure 10A:
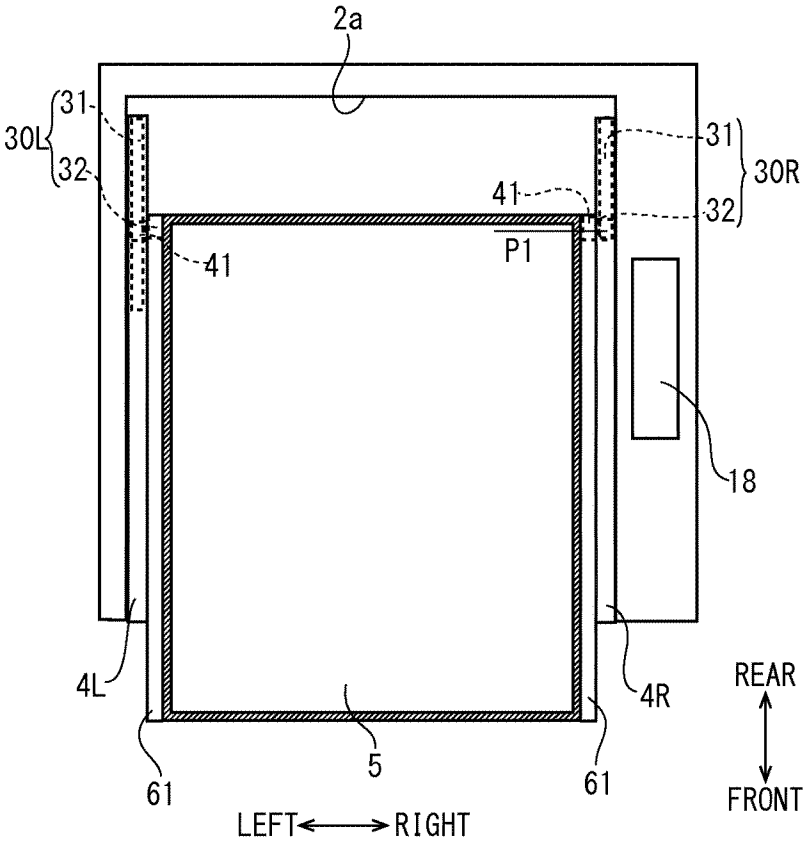
FIG. 10A is a plan view showing the self-closing device, in which a right retracting module reaches the retracting start position, according to the second embodiment of the present disclosure.

If the sheet feeding cassette 5 is further pushed, as shown in FIG. 10A, the engaging part 32 of the left retracting module 30L is retracted toward the retracting end position P2. On the other hand, in the middle of the retracting operation of the left retracting module 30L, the engaging part 32 of the right retracting module 30R engages with the engaged part 31 and then the retracting operation is started. Then, in a region in which the retracting strokes of the left and right retracting modules 30L, 30R overlap each other, the retracting operations are performed simultaneously. At this time, in the left and right retracting modules 30L, 30R, the engaging parts 32 are pulled out by the same stroke from the retracting end positions P2. As described above, since the coil springs 42 of the left and right retracting modules 30L, 30R have the spring constants, in a state in which the engaging parts 32 are pulled out by the same stoke from the retracting end positions P2, a retracting force acting on the sheet feeding cassette 5 in the right retracting module 30R having a short retracting stroke is smaller than that in the left retracting module 30L. Then, as shown in FIG. 10B, the sheet feeding cassette 5 is retracted to the sheet feeding position simultaneously by the left and right retracting modules 30L, 30R.

Next, an operation of pulling out the sheet feeding cassette 5 will be described. At the time of starting pulling out, the force against the biasing force of the coil springs 42 of the engaged parts 31 of the left and right retracting modules 30L, 30R is required. If the sheet feeding cassette 5 is pulled out against the biasing force of the coil springs 42 of the left and right retracting modules 30L, 30R, the engaging part 32 of the right retracting module 30R reaches the retracting start position P1, and the engaging part 32 and the engaged part 31 are disengaged from each other (refer to FIG. 10A). In this manner, in the subsequent retracting operation, the biasing force of the coil spring 42 of the right retracting module 30R does not act.

That is, in the region between the retracting start position P1 of the right retracting module 30R and the retracting start position P1 of the left retracting module 30L, only the biasing force of the coil spring 42 of the left retracting module 30L acts on the sheet feeding cassette 5. If the sheet feeding cassette 5 is pulled out against this biasing force, the engaging part 32 of the left retracting module 30L reaches the retracting start position P1 (refer to FIG. 9B), and the engaging part 32 and the engaged part 31 are disengaged from each other. Afterwards, the sheet feeding cassette 5 is pulled out along the left and right rails 4L, 4R without any resistance (refer to FIG. 9A).

As described above, by the self-closing device 6 according to the second embodiment of the present disclosure as well, in the middle of pulling out the sheet feeding cassette 5, the engaging part 32 and the engaged part 31 in the right retracting module 30R are disengaged from each other and the biasing force in the retracting direction does not act so that a maximum value of pulling out force can be reduced.

Incidentally, in the self-closing device 6 of the second embodiment, at least the left retracting module 30L is preferably provided with the oil damper 43. By providing the oil damper 43 in the retracting module having a longer retracting stroke, an impact absorbing effect of the retracting operation is enhanced, and the sheet feeding cassette 5 can be smoothly retracted.

Next, a self-closing device according to a third embodiment, which is a modification example of the second embodiment above, will be described. In the third embodiment, spring constants of the respective coil springs 42 of the left and right retracting modules 30L, 30R are different from each other.

In the second embodiment, a spring constant of the coil springs 42 of the left retracting module 30L having a longer retracting stroke is the same as a spring constant of the coil spring 42 of the right retracting module 30R having a shorter retracting stroke. On the contrary, in the third embodiment, the spring constant of the coil spring 42 of the left retracting module 30L is set to be smaller than the spring constant of the coil spring 42 of the left retracting module 30L in the second embodiment, and the spring constant of the coil spring 42 of the right retracting module 30R is set to be larger than the spring constant of the coil spring 42 of the right retracting module 30R in the second embodiment.

Therefore, in the third embodiment, at the retracting end position P2, a retracting force of the right retracting module 30R is larger than a retracting force of the left retracting module 30L.

Figure 11A:
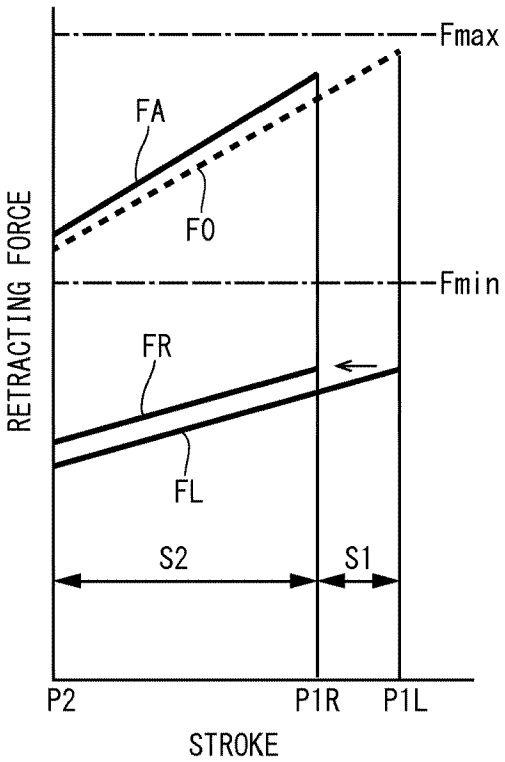
FIG. 11A is a graph showing a relationship between a retracting force acting on the sheet feeding cassette and a stroke of each retracting module in the self-closing device according to the first embodiment of the present disclosure.
Figure 11B:
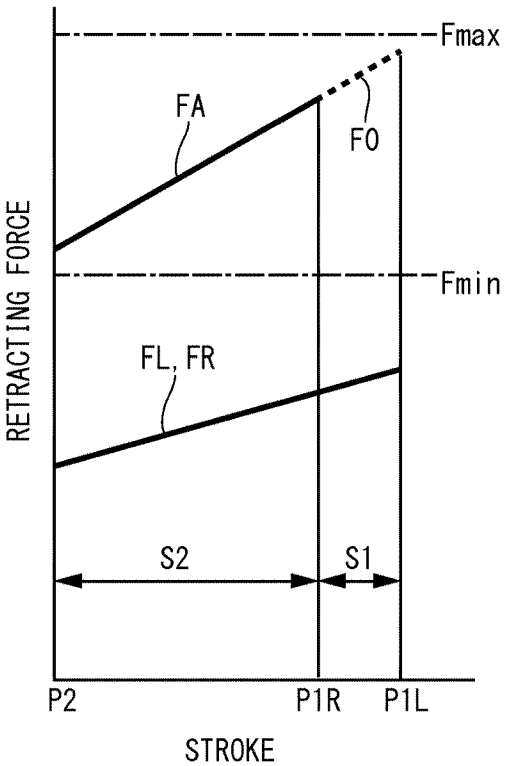
FIG. 11B is a graph showing a relationship between a retracting force acting on the sheet feeding cassette and a stroke of each retracting module in the self-closing device according to the second embodiment of the present disclosure.
Figure 11C:
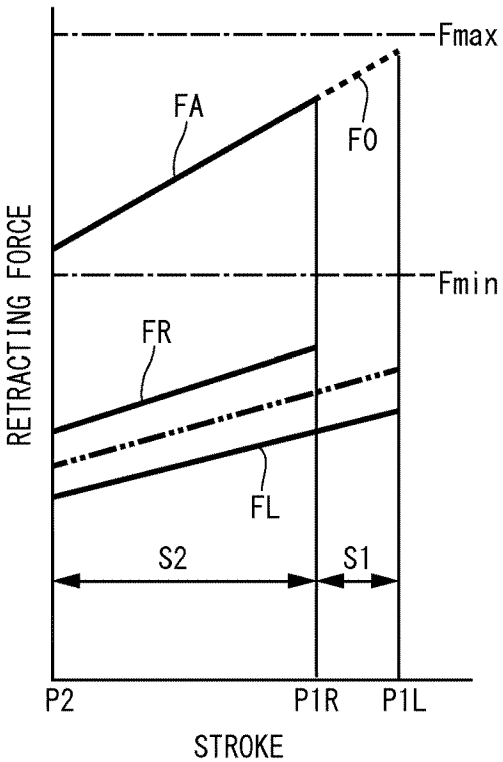
FIG. 11C is a graph showing a relationship between a retracting force acting on a sheet feeding cassette and a stroke of each retracting module in a self-closing device according to a third embodiment of the present disclosure.

Next, with reference to graphs shown in FIGS. 11A to 11C, variations of retracting forces acting on the sheet feeding cassettes 5 in the self-closing devices 6 according to the first to third embodiments will be described. FIG. 11A shows a self-closing device in the first embodiment, FIG. 11B shows a self-closing device in the second embodiment, and FIG. 11C is a self-closing device in the third embodiment. In each graph, the horizontal axis shows a stroke (expansion of the coil spring) of the left and right retracting modules 30R, 30L, and the vertical axis shows a retracting force acting on the left and right retracting modules 30L, 30R and the sheet feeding cassette 5. Also, the solid line of each graph shows a retracting force FL, FR of the left and right retracting modules 30L, 30R and a retracting forces FA (FR+FL) acting on the sheet feeding cassette 5. The dashed line shows a retracting force F0 acting on the sheet feeding cassette 5 in a case where the retracting start position P1 of the right retracting module 30R is the same as the retracting start position P1 of the left retracting module 30L. The lower single-dotted chain line shows a minimum retracting force Fmin required to retract the sheet feeding cassette 5, and the upper single-dotted chain line shows a maximum pulling out force Fmax of the sheet feeding cassette 5 specified under Section 508 of the United State Rehabilitation Act.

In the first to third embodiments, if the retracting start positions P1 of the left and right retracting modules 30L, 30R are the same as each other, as indicated by the dashed lines of FIGS. 11A to 11C, the retracting force of the sheet feeding cassette 5 is close to the maximum pulling out force Fmax, and allowance in the retracting force is decreased.

However, as in the first to third embodiments, if the retracting start position P1R of the right retracting module 30R is positioned on the downstream side in the retracting direction from the retracting start position P1L of the left retracting module 30L, it is possible to reduce a maximum value of the pulling out force acting on the sheet feeding cassette 5. In this manner, a retracting force required to retract the sheet feeding cassette 5 is obtained, and it is also possible to prevent the maximum retracting force acting on the sheet feeding cassette 5 from being close to the maximum pulling out force Fmax. Also, since an entire stroke for retracting the sheet feeding cassette 5 is not reduced, operability at the time of insertion of the sheet feeding cassette 5 or a damper effect or the like is not degraded.

In the sheet feeding cassette 5 in the embodiments of the present disclosure, since the sheets are housed close to the sheet feeding device 18 in the sheet feeding cassette 5, there may be a case in which a load applied from the sheet feeding cassette 5 on the right rail 4R is larger than that on the left rail 4R. Then, as in the third embodiment, the spring constant of the coil spring 42 of the right retracting module 30R is set to be larger than the spring constant of the coil spring 42 of the left retracting module 30L, whereby the retracting force required to retract the sheet feeding cassette 5 can be appropriately distributed into the left and right retracting modules 30, 30R without increasing the maximum retracting force acting on the sheet feeding cassette 5. In this manner, it is possible to always smoothly retract the sheet feeding cassette 5.

Further, self-closing devices 6 according to fourth and fifth embodiments of the present disclosure will be described with reference to FIG. 12A and FIG. 12B.

Figure 12A:
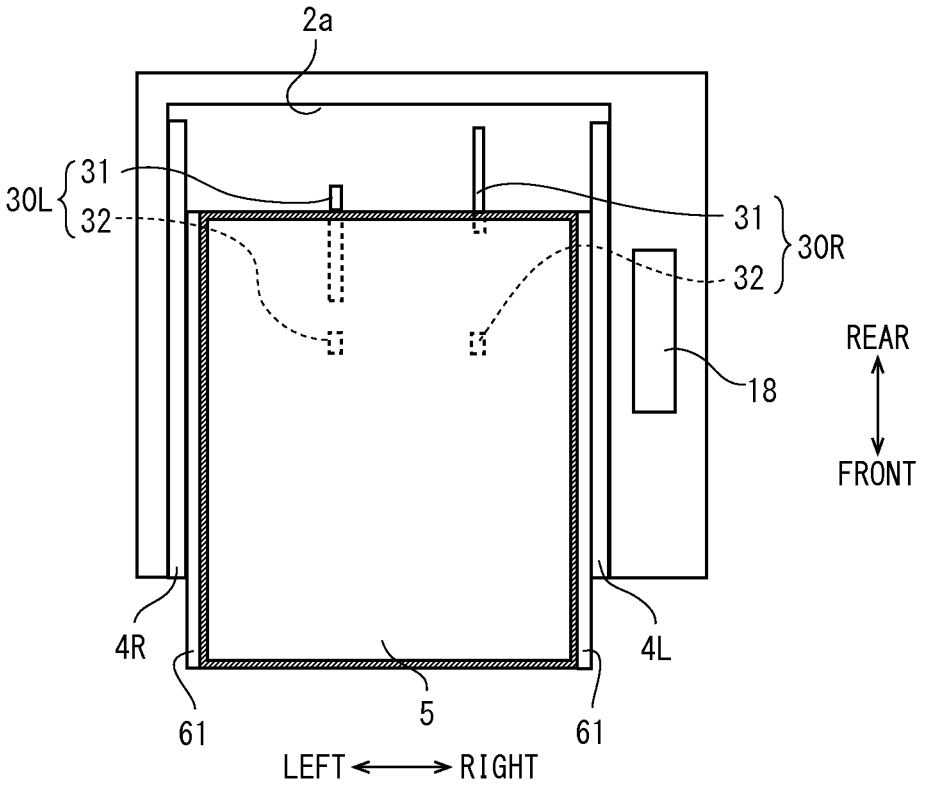
FIG. 12A is a plan view showing a layout of a retracting module in a self-closing device according to a fourth embodiment of the present disclosure.

In the self-closing device according to the fourth embodiment shown in FIG. 12A, the left and right retracting modules 30L, 30R are arranged between a lower face of the sheet feeding cassette 5 and a lower bottom face of the lower space 2*a* of the printer main body 2. That is, the engaged parts 31 of the left and right retracting modules 30L, 30R are arranged such that the retracting start positions are different from each other in the forward/rearward direction on the lower bottom face of the lower space 2*a*, and the engaging parts 32 are arranged so as to be at the same position in the forward/rearward direction on the lower face of the sheet feeding cassette 5.

Figure 12B:
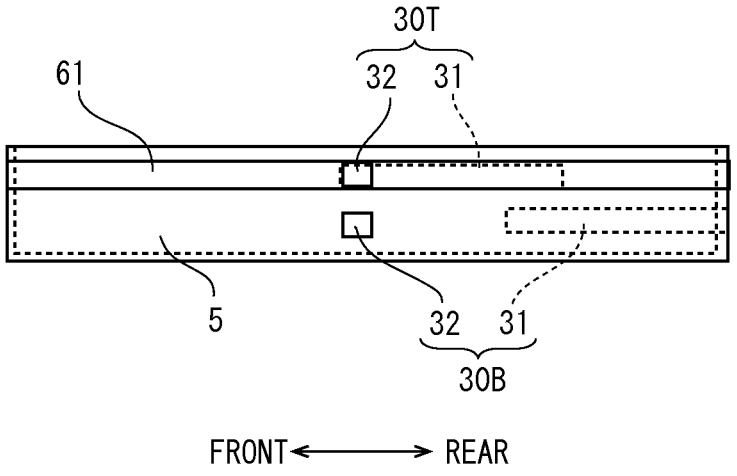
FIG. 12B is a side view showing a retracting module in a self-closing device according to a fifth embodiment of the present disclosure.

In the self-closing device according to the fifth embodiment shown in FIG. 12B, upper and lower retracting modules 30T, 30B are arranged to be vertically arranged in parallel to each other between one side face of the sheet feeding cassette 5 and one side face of the lower space 2*a* of the printer main body 2. That is, the engaged parts 31 of the upper and lower retracting modules 30T, 30B are arranged such that the retracting start positions are different from each other in the forward/rearward direction on the side face of the lower space 2*a*, and the engaging parts 32 are arranged at the same position in the forward/rearward direction on the side face of the sheet feeding cassette 5.

Thus, the retracting modules 30 do not always need to be provided on the left and right rails 4L, 4R, and can be provided at appropriate positions in consideration of precision of positioning into the sheet feeding position or a layout space or the like of the retracting modules 30. Also, three or more retracting modules 30 may be provided. In addition, a plurality of retracting modules 30 may be integrated into a unit so as to operate independently.

The self-closing device 6, in addition to the sheet feeding cassette 5, is applicable to a variety of units removably provided on the printer main body 2, such as a sheet feeding device 18, an image forming unit 9 (such as a developing device 12 or a transferring unit 19), or a fixing device 20.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising a self-closing device configured to retract a sheet feeding cassette which houses a sheet to be image-formed and is capable of being pulled out with respect to an apparatus main body, toward a sheet feeding position, wherein the self-closing device including:

a plurality of retracting modules configured to retract the sheet feeding cassette from a retracting start position towards a retracting end position, wherein the plurality of retracting modules are provided such that retracting strokes from the retracting start position to the retracting end position partially overlap each other and the retracting start positions are different from each other in the retracting direction, the retracting module arranged close to the sheet feeding position has a retracting force higher than a retracting force of the other retracting module at the retracting end position, each of the plurality of retracting modules has a spring member one end of which is engagingly locked with the apparatus main body, the spring member being extended to a direction opposite to the retracting direction with respect to the apparatus main body to generate the retracting force, and the spring constant of the spring member of the retracting module arranged close to the sheet feeding position is higher than the spring constant of the spring member of the other retracting module.

2. The image forming apparatus according to claim 1, wherein the retracting module arranged close to the sheet feeding position has a retracting stroke shorter in length than a retracting stroke of the other retracting module.

3. The image forming apparatus according to claim 1, wherein the retracting module arranged close to the sheet feeding position is configured so that a retracting start timing is later than a retracting start timing of the other retracting module.

4. The image forming apparatus according to claim 1, wherein the retracting module arranged close to the sheet feeding position is so configured that the retracting end position is positioned on a downstream side in the retracting direction from the retracting end position of the other retracting module.

5. The image forming apparatus according to claim 1, wherein the sheet feeding cassette is provided so as to be capable of being pulled out along a rail provided at the apparatus main body, and the self-closing device is arranged between the sheet feeding cassette and the rail.

6. An image forming apparatus comprising a self-closing device configured to retract a sheet feeding cassette which houses a sheet to be image-formed and is capable of being pulled out with respect to an apparatus main body, toward a sheet feeding position, wherein the self-closing device including:

a plurality of retracting modules configured to retract the sheet feeding cassette from a retracting start position towards a retracting end position, wherein the plurality of retracting modules are provided such that retracting strokes from the retracting start position to the retracting end position partially overlap each other and the retracting start positions are different from each other in the retracting direction, wherein each of the plurality of retracting modules includes: an engaged part provided at either one of the apparatus main body and the sheet feeding cassette; and an engaging part provided at the other and configured to engage with the engaged part, the engaged part has: a carriage pin slidable between the retracting start position and the retracting end position; and a spring member configured to bias the carriage pin toward the retracting end position, the engaging part has a recessed part capable of engaging with the carriage pin, and the recessed part of the engaging part is engaged with the carriage pin of the engaged part at the retracting start position and then the carriage pin is retracted toward the retracting end portion by the spring member so that the sheet feeding cassette is retracted with respect to the apparatus main body.

7. The image forming apparatus according to claim 6, wherein the engaged part of the retracting module is provided with a buffering member configured to buffer a biasing force of the spring member.

* * * * *